US009387980B2

(12) United States Patent
Dogan et al.

(10) Patent No.: US 9,387,980 B2
(45) Date of Patent: Jul. 12, 2016

(54) BEVERAGE CAPSULE WITH SAFETY FEATURE

(71) Applicant: NESTEC S.A., Vevey (CH)

(72) Inventors: Nihan Dogan, La Croix-sur-Lutry (CH); Ahmed Azouz, Prilly (CH); Frederic Doleac, Vaux et Chantegrue (FR)

(73) Assignee: Nestec S.A., Vevey (CH)

( * ) Notice: Subject to any disclaimer, the term of this patent is extended or adjusted under 35 U.S.C. 154(b) by 0 days.

(21) Appl. No.: 14/423,486

(22) PCT Filed: Sep. 3, 2013

(86) PCT No.: PCT/EP2013/068172
§ 371 (c)(1),
(2) Date: Feb. 24, 2015

(87) PCT Pub. No.: WO2014/037341
PCT Pub. Date: Mar. 13, 2014

(65) Prior Publication Data

US 2015/0239653 A1 Aug. 27, 2015

(30) Foreign Application Priority Data

Sep. 5, 2012 (EP) ..... 12183162

(51) Int. Cl.
*B65D 85/804* (2006.01)

(52) U.S. Cl.
CPC ..... *B65D 85/8043* (2013.01)

(58) Field of Classification Search
CPC ..... B65D 85/8043
USPC ..... 426/77, 78, 79, 80, 81, 82, 83, 84
See application file for complete search history.

(56) References Cited

U.S. PATENT DOCUMENTS 7,604,826 B2 * 10/2009 Denisart ..... B65D 81/00 426/112
2009/0211458 A1 * 8/2009 Denisart ..... B65D 85/8043 99/300
2010/0307930 A1 12/2010 Zangerle

FOREIGN PATENT DOCUMENTS

CN 102001496 4/2011
EP 1500358 1/2005

(Continued)

OTHER PUBLICATIONS

Chinese Office Action for Chinese Appl No. 201380046303.0 dated Dec. 28, 2015.

*Primary Examiner* — Erik Kashnikow
*Assistant Examiner* — Ericson M Lachica
(74) *Attorney, Agent, or Firm* — K&L Gates LLP

(57) ABSTRACT

The present invention concerns a capsule (12) for the preparation of a food or beverage by injection therein of a fluid under pressure, comprising a chamber containing a substance, a bottom pierceable membrane (23), and opening means (24) allowing the capsule to be opened by piercing the bottom membrane for allowing the beverage to flow out of the capsule, the opening means (24) comprising a surface with a multitude of piercing elements (25) which are configured to engage the bottom membrane (23) under the effect of the rise in pressure in the chamber, characterized in that said opening means (23) further comprises at least one safety piercing element (26) that is surrounded by a safety wall (27) such that the apex (28) of said safety piercing element is located within the vicinity of said safety wall (27).

11 Claims, 3 Drawing Sheets

(56) References Cited

FOREIGN PATENT DOCUMENTS

| | | | | | | |
|---|---|---|---|---|---|---|
| EP | 2236437 | 10/2010 | | | | |
| NL | WO 2011159162 | A1 * | 12/2011 | ..... | A47J 31/0673 | |
| WO | 2011159162 | | 12/2011 | | | |

* cited by examiner

BEVERAGE CAPSULE WITH SAFETY FEATURE

CROSS REFERENCE TO RELATED APPLICATIONS

The present application is a National Stage of International Application No. PCT/EP2013/068172, filed on Sep. 3, 2013, which claims priority to European Patent Application No. 12183162.2, filed on Sep. 5, 2012, the entire contents of which are being incorporated herein by reference.

FIELD OF THE INVENTION

The present invention concerns a capsule for food and/or beverage preparation suitable for use with a beverage preparation machine, that comprises a built-in feature for emergency opening.

BACKGROUND OF THE INVENTION

Beverage preparation machines are well known in the food industry and consumer goods area. Such machines allow a consumer to prepare at home a given type of beverage, for instance a coffee-based beverage, e.g. an espresso or a brew-like coffee cup.

Today, most beverage preparation machines for in-home beverage preparation comprise a system made of a machine which can accommodate portioned ingredients for the preparation of the beverage. Such portions can be soft pods or pads, or sachets, but more and more systems use semi-rigid or rigid portions such as rigid pods or capsules. In the following, it will be considered that the beverage machine is a beverage preparation machine working with a rigid or semi-rigid capsule.

The machine preferably comprises a receptacle for accommodating said capsule and a fluid injection system for injecting a fluid, preferably water, under pressure into said capsule. Water injected under pressure in the capsule, for the preparation of a coffee beverage, is preferably hot, that is to say at a temperature above 70° C. However, in some particular instances, it might also be at ambient temperature, or even at a chilled temperature. The pressure inside the capsule chamber during extraction and/or dissolution of the capsule contents is typically about 1 to about 8 bar for dissolution products and about 2 to about 12 bar for extraction of roast and ground coffee. The present invention could also encompass the so-called "brewing" process of beverage preparation—particularly for tea and coffee. Brewing involves a time of infusion of the ingredient by a fluid (e.g. hot water), whereas the extraction or dissolution preparation process allows a consumer to prepare a beverage, for instance coffee, within a few seconds.

Generally, in the following specification, the term "brewing" of an ingredient by a fluid, is meant to encompass extraction of a powdered edible material such as for instance roast and ground powdered coffee, or dissolution of edible soluble material such as for instance soluble tea or coffee, milk, cocoa mixes, or infusion of an edible material with an infusion fluid under very low relative pressure, or atmospheric pressure, for a longer time than that required for extraction or dissolution, for instance infusion of tea leaves by hot water.

The principle of extracting and/or dissolving the contents of a closed capsule under pressure is known and consists typically of confining the capsule in a receptacle of a machine, injecting a quantity of pressurized water into the capsule, generally after piercing a face of the capsule with a piercing injection element such as a fluid injection needle mounted on the machine, so as to create a pressurized environment inside the capsule either to extract the substance or dissolve it, and then release the extracted substance or the dissolved substance through the capsule. Capsules allowing the application of this principle have already been described for example in applicant's European patent no EP 1 472 156 B1, and in EP 1 784 344 B1.

Machines allowing the application of this principle have already been described for example in patents CH 605 293 and EP 242 556. According to these documents, the machine comprises a receptacle for the capsule and a perforation and injection element made in the form of a hollow needle comprising in its distal region one or more liquid injection orifices. The needle has a dual function in that it opens the top portion of the capsule on the one hand, and that it forms the water inlet channel into the capsule on the other hand.

The machine further comprises a fluid tank—in most cases this fluid is water—for storing the fluid that is used to dissolve and/or infuse and/or extract under pressure the ingredient(s) contained in the capsule. The machine comprises a heating unit such as a boiler or a heat exchanger, which is able to warm up the water used therein to working temperatures (classically temperatures up to 80-90° C.). Finally, the machine comprises a pump element for circulating the water from the tank to the capsule, optionally though the heating unit. The way the water circulates within the machine is e.g. selected via a selecting valve means, such as for instance a peristaltic valve of the type described in applicant's European patent application EP 2162653 A1.

When the beverage to be prepared is coffee, one interesting way to prepare the coffee is to provide the consumer with a capsule containing roast and ground coffee powder, which is to be extracted with hot water injected therein.

Capsules have been developed for such an application, which are described and claimed in applicant's European patent EP 1 784 344 B2, or in European patent application EP 2 062 831.

In short, such capsules typically comprise:

- a hollow body and an injection wall which is impermeable to liquids and to air and which is attached to the body and adapted to be punctured by e.g. an injection needle of the machine,
- a chamber containing a bed of roast and ground coffee to be extracted or a soluble beverage precursor ingredient, e.g. a milk based powder or soluble powdered tea,
- an aluminium membrane disposed at the bottom end of the capsule, that hermetically closes the capsule, for retaining the internal pressure in the chamber, this bottom membrane being associated with piercing means for piercing dispensing holes in the aluminium membrane when the internal pressure inside the chamber reaches a certain pre-determined value,
- optionally, means configured to break the jet of fluid so as to reduce the speed of the jet of fluid injected into the capsule and distribute the fluid across the bed of substance at a reduced speed. It is often important for the user to know when the water level in the machine tank is too low to prepare a full beverage.

In many instances, the capsules for use in beverage preparation machines are closed capsules as described above. Such closed capsules are interesting because they protect the ingredient contained therein from ambient gas and moisture and allow long conservation time. Typically, such closed capsules are made from gas and/or moisture impermeable material and feature a rigid or semi-rigid body having a one of its walls—for instance the top wall—made from a membrane which is to be pierced by the fluid injection needle of the beverage preparation machine. When liquid is injected in the capsule compartment, a pressure is built up, which serves as an extraction means for extracting ingredients contained inside the capsule through a dispensing wall of the capsule—typically the bottom wall—.

However, beyond their clear benefits for the consumer as described above, closed capsules may also raise certain issues.

It was found that in some—generally exceptional—cases, when the machine starts injecting fluid (e.g. water) under pressure within the capsule, the opening of the membrane located at the dispensing side of the capsule does not occur properly when fluid pressure inside the capsule builds-up. More precisely, it was found that in such cases, the capsule dispensing side opens, and in some cases, a few drops of product may start to flow through the dispensing side of the capsule. However, due to product characteristics, in particular, due to some aggregates of undissolved ingredient, or due to big particles, the holes in the dispensing side of the capsule are almost immediately clogged in such a way that the end product cannot flow properly therethrough towards a consumer cup, as it should normally be the case.

As a first result, the beverage is not dispensed to the consumer, who has to withdraw the blocked capsule from the machine, and replace it with a new one. This withdrawal operation may however be messy, because the fluid inside the capsule is under pressure, and when the consumer opens the machine, the injection needle is removed from the top wall (e.g. top membrane) of the capsule, and fluid under pressure flows, or sometimes even sprays, out of the capsule, which is of course undesirable.

More than that, in some instances, the beverage preparation machine comprises a security, which prevents opening of its capsule compartment until in-capsule pressure has not decreased to a predetermined value. In case of capsule blockage, the machine cannot be re-opened, unless the capsule is pierced using a piercing tool, for instance by accessing the dispensing pierceable membrane from below said capsule, which is also undesirable and not user-friendly.

Although such cases of blocked capsules are exceptional, it is highly desirable to provide a solution which prevents capsule blockage. This is the primary objective of the present invention.

SUMMARY OF THE INVENTION

The main objective set out above is met with a capsule for the preparation of a food or beverage by injection therein of a fluid under pressure, comprising a chamber containing a substance, a bottom pierceable membrane, and opening means allowing the capsule to be opened by piercing the bottom membrane for allowing the beverage to flow out of the capsule, the opening means comprising a surface with a multitude of piercing elements which are configured to engage the bottom membrane under the effect of the rise in pressure in the chamber, characterized in that said opening means further comprises at least one safety piercing element that is surrounded by a safety wall such that the apex of said safety piercing element is located within the vicinity of said safety wall.

Importantly, and as explained above, it may happen that due to the characteristics of the substance initially contained in the capsule which is meant to be dissolved with a fluid injected inside the capsule for making the final product, the normal dispensing openings created by piercing of the bottom membrane by the piercing elements are clogged by big particles and the dispensing flow stops (i.e. the capsule is blocked). In that case, the fluid pressure inside the capsule will continue to build-up as more mixing fluid (e.g. water) is injected therein, which will press onto the safety wall up to the point where it will actually enter slightly into said wall vicinity and be pierced by the safety piercing element contained therein. As it can be understood, in normal conditions where the product is dispensed outside of the capsule, the internal pressure inside the capsule is not sufficient to push the bottom membrane inside the vicinity of the safety wall. Therefore, in normal conditions of use, the safety piercing element is not used, as the regular piercing elements—which are not surrounded by safety walls—are sufficient to create dispensing opening of the capsule.

It was found that the ratio "height of the safety piercing element, to height of the safety wall" substantially determines the safety opening pressure, i.e. the opening pressure in case the normal opening of the capsule does not occur. The higher the ratio, the lower the opening pressure will be. Also the height and shape of the safety piercing element controls the opening pressure and opening time. This ratio should be preferably comprised between 0.5 and 1, having regard to the fact the base of the safety piercing element and the safety wall are on the same level. In other words, the safety piercing element should be dimensioned such that its height is comprised between half the size of the safety wall, and the full height of the safety wall (in that case, the apex of the safety piercing element is on the same level as the upper edge of the safety wall. Therefore, according to the invention the safety piercing element never protrudes outside of the safety wall vicinity, and is therefore accessible to the bottom membrane of the capsule only in cases where the pressure inside the capsule exceeds the normal use pressure (in case the normal piercing elements do not function properly).

More preferably, the ratio "height of the safety piercing element to height of the safety wall" should be comprised between 0.7 and 0.9.

Preferably, the surface of the opening means is at least partially open in its portion located between the safety wall and the safety piercing element, such that fluid can flow between both sides of said surface.

The safety wall can be cylindrical, which is easier to manufacture by injection moulding.

Preferably, the internal diameter of said safety wall is comprised between 1 and 10 mm, preferably between 2 and 5 mm.

Also preferably, the apex of the safety piercing element is conical.

The piercing element can be hollow, or plain.

In a first embodiment of the invention, the safety piercing element and the safety wall are integrally moulded with the opening means.

In a second alternative embodiment of the invention, the safety piercing element is an independent element that is attached, welded, or similarly secured inside the safety wall of the opening means.

In the latter case, the piercing element can advantageously comprise a base attached to the internal surface of the safety wall, said base having a cross section inferior to the corresponding inner cross section of said safety wall along at least one radial direction.

BRIEF DESCRIPTION OF THE DRAWINGS

Additional features and advantages of the present invention are described in, and will be apparent from, the description of the presently preferred embodiments which are set out below with reference to the drawings in which.

DETAILED DESCRIPTION OF THE INVENTION

Figure 1:
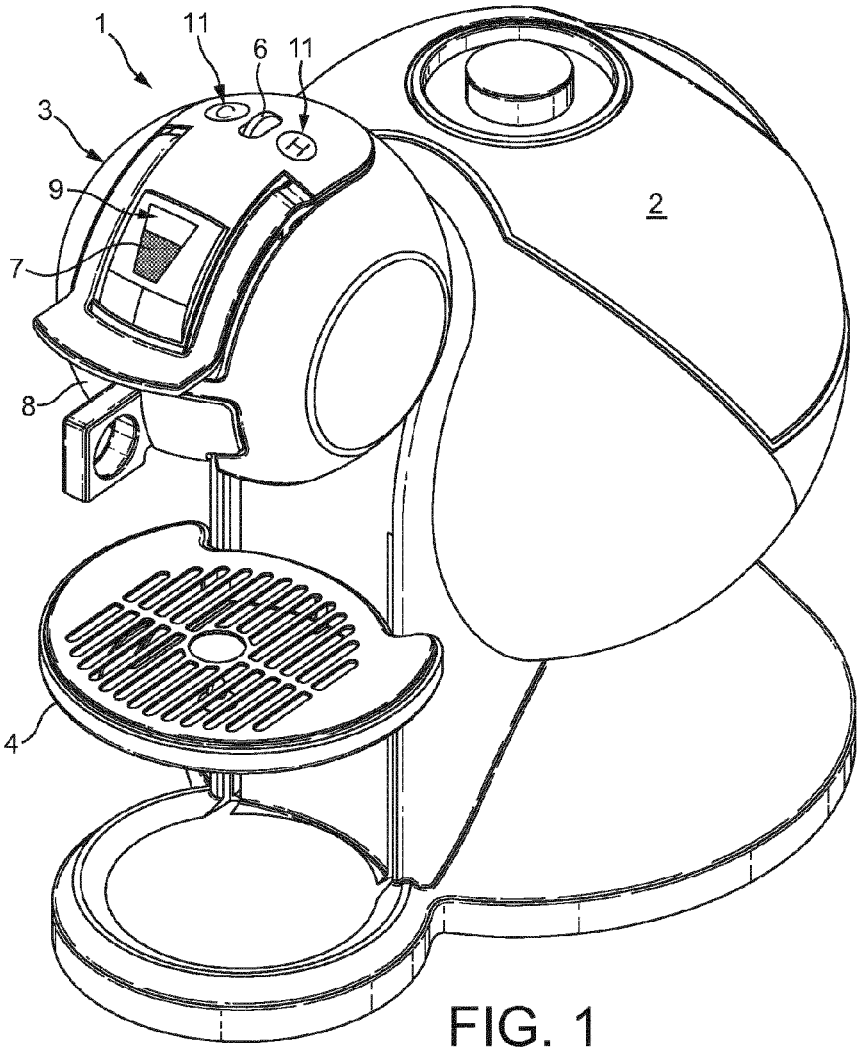
FIG. 1 is a schematic perspective view of a beverage preparation machine according to the invention.

The present invention concerns a machine 1 of the type illustrated in FIG. 1. Such a machine 1 comprises a water reservoir 2, a brewing head 3, a cup tray 4 that can be set at different heights relative to the brewing head, control panel and buttons. In a possible embodiment, the control buttons comprise more particularly a rotating wheel 6 and the control panel is a screen 7. An ingredient capsule can be placed in a capsule holder 8 which is removably inserted into the brewing head 3. The screen 7 is suitable for displaying various information to the consumer, for instance the volume level 9 that is dispensed in the cup. The user can also choose the temperature of the beverage that will be prepared, by actuating hot or cold buttons 11 which are present close to the wheel and screen on the surface of the brewing head.

Figure 2:
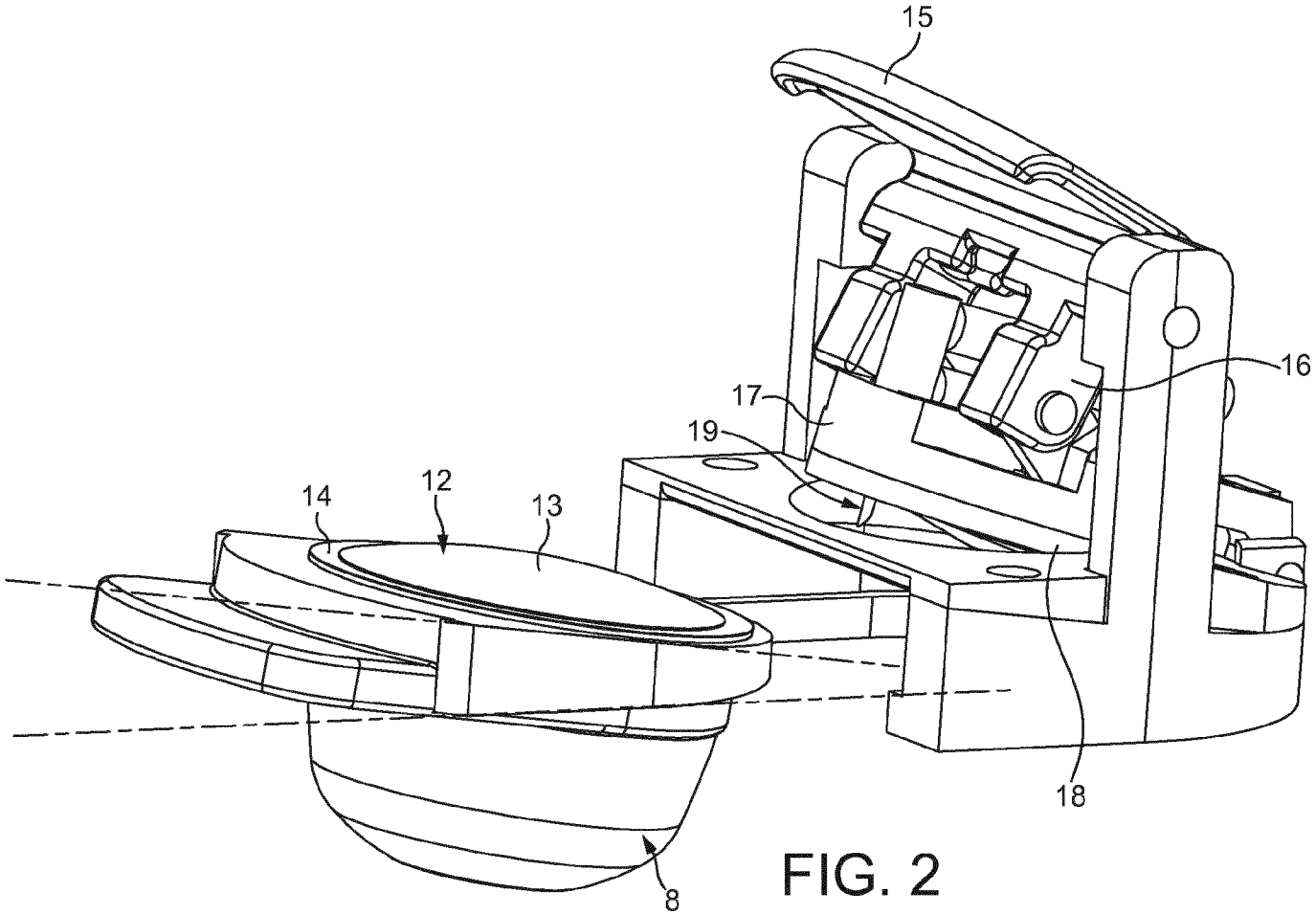
FIG. 2 is a schematic enlarged perspective view showing the interior of the brewing head of a machine as illustrated in FIG. 1.

FIG. 2 represents schematically the internal configuration of an embodiment of a brewing head 3 in its open position. The capsule holder 8 is loaded with a capsule 12. The capsule has a top pierceable membrane 13, and top peripheral edge 14. The brewing head 3 typically comprises an open/close mechanism with a handle 15 and a knee mechanism 16 that mechanically links the handle to a support plate 17. The support plate 17 carries an injection plate 18 that is moved in direct contact with the peripheral edges 14 and top membrane 13 of the capsule in a leaktight manner, when the brewing head is in the closed position. The injection plate is a needle plate 18 that carries one injection needle 19 to pierce through the top membrane of the capsule when the brewing head is closed. The needle 19 is linked in a fluidic manner (via pipes) to the pump, heating element, and reservoir (elements not shown in the drawing) of the machine.

Figure 3:
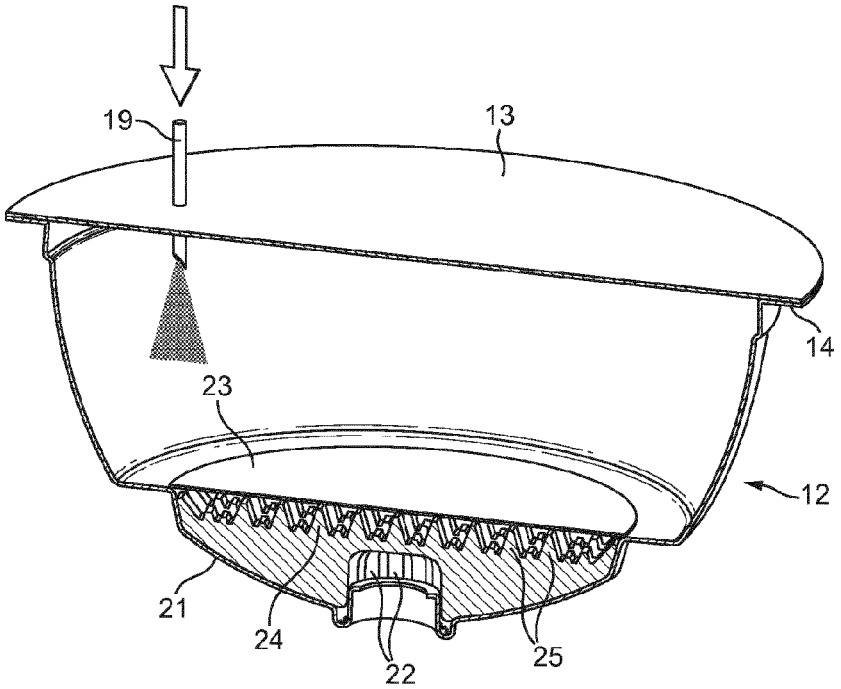
FIG. 3 is a schematic perspective cut view of a capsule according to the invention.

As illustrated in FIG. 3, the capsule comprises a capsule side wall 20, a capsule top wall 13 which is a membrane sealed onto the surface of the top peripheral edge 14 of the capsule, said membrane being pierceable by the needle 19 for injection of water under pressure, as illustrated in FIG. 3. The capsule further comprises a bottom wall 21 having a bottom dispensing opening 22 through which the beverage prepared within the capsule flows by gravity and is dispensed within a cup placed there below. The capsule is hermetically sealed by a flexible pierceable bottom membrane 23. The bottom membrane 23 can be for instance an aluminium membrane coated with a thermoplastic on its lower surface so as to be sealable onto the inner surface of the capsule.

Figure 4:
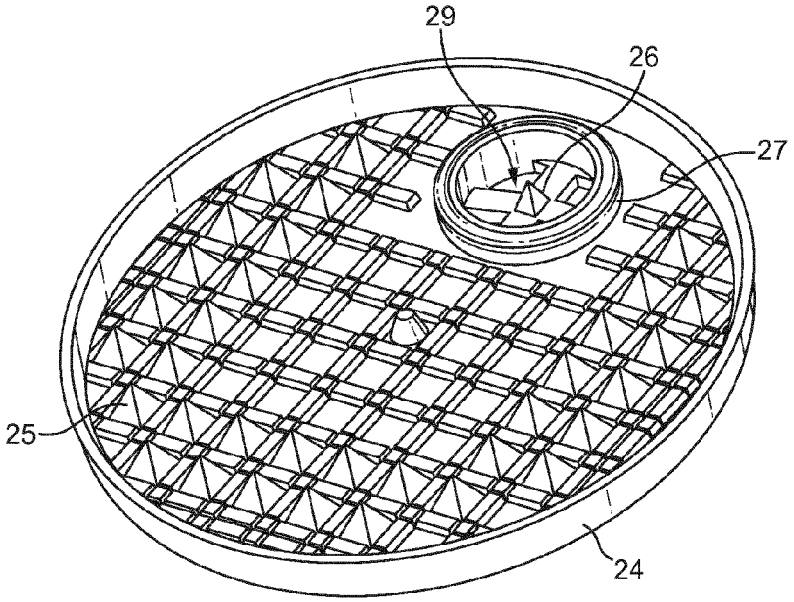
FIG. 4 is a schematic perspective top view of a piercing plate according to the invention.

As shown in FIG. 4, the capsule 12 further comprises opening means 24 comprising a surface with a multitude of piercing elements 25 which are configured to engage the bottom membrane 23 under the effect of the rise in pressure in the capsule chamber. The piercing elements are preferably pyramid shaped with a cut apex.

According to the invention, and as illustrated in FIG. 4, the opening means further comprises a safety piercing element 26 that is surrounded by a safety wall 27. The height of the safety channel 29 relative to the safety piercing element 26 is such that the apex 28 of said safety piercing element is located within the vicinity of said channel 29 as shown in FIG. 4. The internal diameter of said safety channel is about 4 mm. The safety piercing element and the safety channel are integrally moulded with the opening means. The shape of the safety piercing element can be of any suitable shape such as a cone or a pyramid for instance. Preferably, the apex 28 of the safety piercing element is sharp. The surface of the opening means 24 is open with safety channels 29 so that fluid can pass trough and flow through the dispensing opening of the capsule.

During normal operation, the pressure builds-up within the capsule, and the latter opens at its dispensing—bottom—side to let the beverage flow out into a cup placed below, as explained here above.

In case of a capsule blockage, when fluid pressure builds-up within the capsule, its bottom membrane will flex downwards and its shape will tightly conform to the lower surface of the piercing plate, entering into the cylindrical chamber as well. It will then contact the apex of the piercing element, which will pierce said bottom membrane to release the pressure and unblock the capsule. The pressurized fluid advantageously flows through the exit channels towards the dispensing opening of the capsule, as in a normal dispensing cycle.

By unblocking the capsule, the machine security—if one is present—is disconnected, which allows the user to unlock the brewing head of said machine, and use it as usual.

It was found that placing the apex of the safety piercing element slightly inside the cylindrical channel of the piercing plate, at a distance from the upper edge of said channel which is not greater than 1 mm, and designing said channel with a diameter of between 2 and 5 mm, allows to guarantee that the bottom membrane of the capsule will flex downwards and be pierced—in case of capsule blockage—when the fluid pressure inside the capsule is slightly above the maximum normal opening pressure of said capsule, i.e. at a pressure inside the capsule that is comprised between 10 and 15 bar.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

The invention claimed is:

1. A capsule for the preparation of a food or a beverage by injection therein of a fluid under pressure, the capsule comprising:

a chamber containing a substance;

a bottom pierceable membrane; and an opening member allowing the capsule to be opened by piercing the bottom membrane for allowing the food or the beverage to flow out of the capsule, the opening member comprising a surface with a multitude of piercing elements configured to engage the bottom membrane under the effect of the rise in pressure in the chamber, the opening member comprises at least one safety piercing element surrounded by a safety wall such that an apex of the at least one safety piercing element is located within the vicinity of the safety wall, at least a portion of the multitude of piercing elements are exterior to the safety wall on an opposite side of the safety wall from the at least one safety piercing element, and a ratio of a height of the at least one safety piercing element to a height of the safety wall is between 1:2 and 1:1.

2. The capsule according to claim 1, wherein the surface of the opening member is at least partially open with safety channels in a portion of the opening member located between the safety wall and the at least one safety piercing element, such that the fluid can flow between both sides of the surface.

3. The capsule according to claim 1, wherein the safety wall is cylindrical.

4. The capsule according to claim 1, wherein an internal diameter of the safety wall is between 1 and 10 mm.

5. The capsule according to claim 1, wherein the apex is conical.

6. The capsule according to claim 1, wherein the at least one safety piercing element is hollow.

7. The capsule according to claim 1, wherein the at least one safety piercing element is pyramid-shaped.

8. The capsule according to claim 1, wherein the at least one safety piercing element and the safety wall are integrally moulded with the opening member.

9. The capsule according to claim 1, wherein the at least one safety piercing element is an independent element that is attached, welded, or similarly secured inside a safety channel of the opening member.

10. The capsule according to claim 9, wherein the at least one safety piercing element comprises a base attached to an internal surface of the safety wall, the base having a cross section less than a corresponding inner cross section of the safety wall along at least one radial direction.

11. The capsule according to claim 1, wherein the ratio of the height of the at least one safety piercing element to the height of the safety wall is between 0.7 and 0.9.

* * * * *